US007647699B1

(12) United States Patent
Geile

(10) Patent No.: US 7,647,699 B1
(45) Date of Patent: Jan. 19, 2010

(54) RUG SHAVER

(76) Inventor: Christina M. Geile, 6015 Linton St., Jupiter, FL (US) 33458-6747

( * ) Notice: Subject to any disclaimer, the term of this patent is extended or adjusted under 35 U.S.C. 154(b) by 183 days.

(21) Appl. No.: 12/022,083

(22) Filed: Jan. 29, 2008

(51) Int. Cl.
*B26B 19/38* (2006.01)
*B26B 19/14* (2006.01)
*B26B 19/44* (2006.01)

(52) U.S. Cl. ..... 30/43.4; 30/41; 30/41.5; 30/50; 30/133

(58) Field of Classification Search ..... 30/43.6, 30/43.4, 45, 47, 50, 541, 526, 537, 49, 529, 30/346.55, 346.57, 41, DIG. 1, 41.5, 133, 30/41.6, 43.1, 89, 43.5, 388, 514, 516, 517, 30/173, 191, 192, 299, 300, 301; 15/344, 15/329, 144.4; 425/809; D28/49–53
See application file for complete search history.

(56) References Cited

U.S. PATENT DOCUMENTS 2,916,821 A * 12/1959 Witmer ..... 30/41.5
3,125,807 A * 3/1964 Bayard ..... 30/34.1
3,369,294 A * 2/1968 Shaw et al. ..... 30/41.5
3,611,566 A 10/1971 Brennan
3,634,935 A * 1/1972 Battigalli ..... 30/41.5
3,797,109 A * 3/1974 Yamada et al. ..... 30/43.1
4,604,800 A * 8/1986 Yamamoto et al. ..... 30/41
4,788,769 A 12/1988 Maruyama
4,985,999 A 1/1991 Iwasaki et al.
D314,642 S * 2/1991 Ying ..... D28/50
D321,115 S 10/1991 Henry
5,341,570 A * 8/1994 Kumakawa ..... 30/43.6
5,361,453 A 11/1994 Gerber
5,623,745 A 4/1997 Stanek
6,978,547 B2 * 12/2005 Degregorio, Jr. ..... 30/133
7,293,322 B2 * 11/2007 Matousek et al. ..... 15/320
7,475,481 B1 * 1/2009 Napoli ..... 30/43.4
2002/0073549 A1 * 6/2002 McCambridge et al. ..... 30/41.5

* cited by examiner

*Primary Examiner*—Ghassem Alie

(57) ABSTRACT

Disclosed is a rug shaver for removing pilling and other loose fibers. The rug shaver may include a handle connected to a shaver head through a swivel. The shaver head may have a motor that rotates blades above a grill plate. The shaver head also may include baskets removeably retained within basket cutouts in a top of the shaver head. As pilling and other loose fibers poke through the grill plate, the rotating blades may cut the loose fibers. The loose fibers may be drawn into the baskets.

18 Claims, 6 Drawing Sheets

RUG SHAVER

BACKGROUND

1. Field

The information disclosed in this patent relates to a rug shaver in which the blades have a rotary motion during removal of pilling and other loose fibers by the rug shaver.

2. Background Information

Fabric is a flexible material made up of a network of fibers (thread or yarn) formed by weaving or knitting (textiles), or pressed into felt. Fabric has a tendency to accumulate (ball up) on the surface of the fabric, usually due to general wear and tear. These small bobbles of fabric that develop on the fabric surface typically are called pilling. The degree of pilling may depend on the type of fabric, the structure of the fabric, and the finish of the fabric.

Pilling in floor carpets and rugs results when small "pills" of fiber appear on the top of the rug. Some pilling may occur as a result of the type of fiber used to manufacture the rug and the level of foot traffic. It is desirable to remove the pilling from carpets, rugs, blankets, bedspreads, and other fabric.

SUMMARY

This patent discloses a rug shaver to remove pilling and other loose fibers. The rug shaver may include a handle connected to a shaver head through a swivel. The shaver head may have a motor that rotates blades above a grill plate. The shaver head also may include baskets removeably retained within basket cutouts in a top of the shaver head. As pilling and other loose fibers poke through the grill plate, the rotating blades may cut the loose fibers. The loose fibers may be drawn into the baskets.

DETAILED DESCRIPTION

Figure 1:
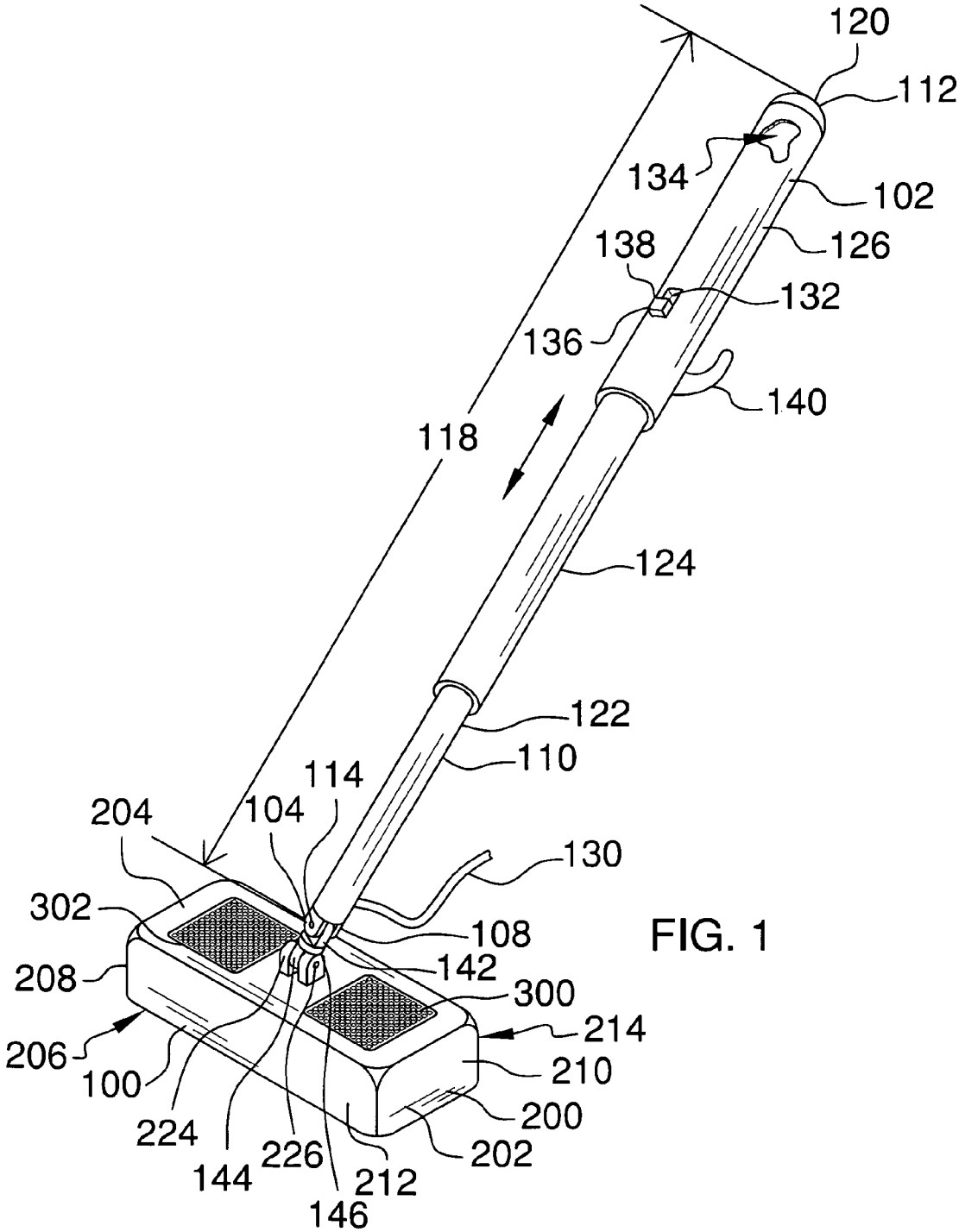
FIG. 1 is an isometric view of a rug shaver 100.
Figure 2:
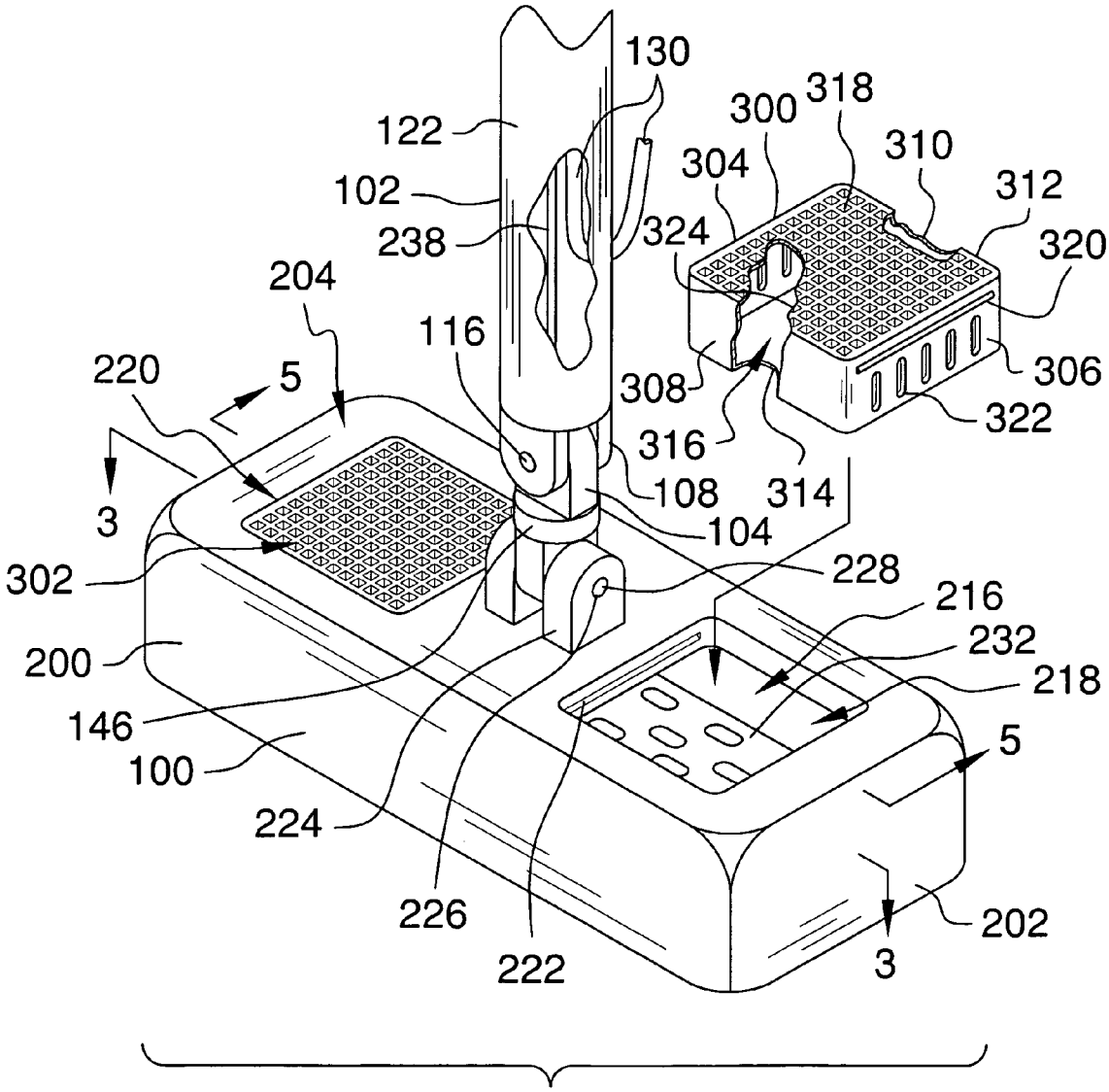
FIG. 2 is an isometric view of rug shaver 100 enlarged, partially exploded, and with elements removed to show details of shaver head 200.

FIG. 1 is an isometric view of a rug shaver 100. Rug shaver 100 may be a small appliance configured to remove pilling or fuzz from rugs, blankets, bedspreads, and various other household items. Rug shaver 100 may include a handle 102, a swivel 104, and a shaver head 200, where swivel 104 may connect handle 102 to shaver head 200. FIG. 2 is an isometric view of rug shaver 100 enlarged, partially exploded, and with elements removed to show details of shaver head 200.

Handle 102 may be an appendage to shaver head 200 that may be designed to be held while rug shaver 100 is in use. Handle 102 may include a handle clevis 108, shaft sections 110, a handle cap 112. Shaft sections 110 may be positioned between handle clevis 108 and handle cap 112.

Handle clevis 108 may be a coupler shaped like the letter U with handle clevis holes 114 through each end. Handle clevis holes 114 (FIG. 1) may be openings in handle clevis 108 that may be aligned to receive a handle clevis pin 116 (FIG. 2) through handle clevis holes 114 to complete a coupling. Handle clevis pin 116 may be an axis made of a short shaft that may support swivel 104 and permit swivel 104 to turn about handle clevis pin 116.

Handle 102 may include a handle length 118 as measured from handle clevis holes 114 to a handle cap end 120 of handle cap 114. Shaft sections 110 may include parts that may slide one within another to vary handle length 118. Handle length 118 may be varied by a consumer to permit the consumer to utilize rug shaver 100 while the consumer is standing upright and utilize rug shaver 100 when the consumer is in close proximity to an item while removing pilling. Handle length 118 should not be so long as to make standing use of rug shaver 100 awkward or so short as to make close proximity use of rug shaver 100 awkward. In one example, rug shaver 100 may not extend beyond a handle length 118 of five feet and may not extend below a handle length 118 of two feet.

Shafts section 110 may include a first shaft section 122, a second shaft section 124, and a third shaft section 126. First shaft section 122 may be attached to handle clevis 108 and may be configured to slide inside second shaft section 124. Second shaft section 124 may be configured to slide outside of first shaft section 122 and slide inside third shaft section 126. Third shaft section 126 may be configured to slide outside of second shaft section 124 at a first third shaft section end and may be attached to handle cap 112 at a second third shaft section end First shaft section 122 may be a cylindrical, hollow tube having a first shaft section hole 128 (FIG. 8) positioned adjacent to handle clevis 108. First shaft section hole 128 may be an opening through first shaft section 122 to permit a power cord 130 (FIG. 2) to pass there through. Power cord 130 may be part of a cable that may assist to temporarily connect an electrical appliance, such as rug shaver 100, to an electrical power source.

Second shaft section 124 may be a cylindrical, hollow tube. In one example, second shaft section 124 may be twisted one way to lock second shaft section 124 in place against first shaft section 122 and may be twisted the opposite way to unlock second shaft section 124 from first shaft section 122 and permit second shaft section 124 to move relative to first shaft section 110. In another example, second shaft section 124 may include a spring-driven button configured to snap into a mating hole positioned in first shaft section 122 to lock adjoining second shaft section 124 and first shaft section 122 in place relative to each other.

Third shaft section 126 may be a cylindrical, hollow tube. In one example, third shaft section 126 may be twisted one way to lock third shaft section 126 in place against second shaft section 124 and may be twisted the opposite way to unlock third shaft section 126 from second shaft section 124 and permit third shaft section 126 to move relative to first shaft section 110. In another example, third shaft section 126 may include a spring-driven button configured to snap into a mating hole positioned in second shaft section 124 to lock adjoining third shaft section 126 and second shaft section 124 in place relative to each other.

Third shaft section 126 may include a third shaft section slot 132 leading to a third shaft section interior 134 positioned inside of third shaft section 126. A power switch 136 having a power switch lever 138 may be mounted within third shaft section interior 134. Power switch 136 may be a control to make, break, and change the connections in a circuit. Power switch lever 138 may extend from third shaft section interior 134 through third shaft section slot 132 and away from third shaft section 126 so that power switch lever 138 may be operated by a finger or thumb.

Handle cap 112 may be a top connected to third shaft section 126 to enclose third shaft section interior 134. Handle cap end 120 may be positioned at a most remote location on handle cap 112 and on rug shaver 100. In one example, handle cap 112 may have a hemispherical shape.

Rug shaver 100 additionally may include a cord storage hook 140. Cord storage hook 140 may be a peg curved upright and away from shaver head 200 to receive power cord 130 wrapped about it. Cord storage hook 140 may be attached to third shaft section 126 on a side of third shaft section 126 that may be opposite of third shaft section slot 132.

Swivel 104 may be a coupler with a first swivel mount 142 and a second swivel mount 144 that may be connected on opposite sides of a pivoting joint 146. A swivel hole 106 (FIG. 5) may pass through each of first swivel mount 142, pivoting joint 146 and second swivel mount 144. First swivel mount 142 may have a first swivel mount hole (hidden) through which handle clevis pin 116 (FIG. 2) may pass. Second swivel mount 144 may have a second swivel mount hole (hidden) through which a shaver head clevis pin 228 may pass. Pivoting joint 146 may be barrel shaped and first swivel mount 142 and second swivel mount 144 may rotate horizontally freely relatively to each other and to pivoting joint 146.

Shaver head 200 may be that portion of rug shaver 100 configured to come in contact with fabric to remove the pilling and other loose fibers from carpets, rugs, blankets, bedspreads, and other fabric. Rug shaver 100 may include a first basket 300 and a second basket 302. Fibers cut by shaver head 200 may be received and temporarily stored in first basket 300 and second basket 302 for later disposal.

Shaver head 200 may include a container 202 having a container top 204, a container bottom 206, a container left side 208, a container right side 210, a container front 212, and a container rear 214. The terms left side, right side, front, and rear are relative to the viewer's perspective and are use only to provide distinguishing designations and are not to be used as limitations on the element.

Container 200 generally may have a rectangular, hollow shape with rounded exterior corners. Container left side 208 and container right side 210 may be attached between container front 212 and container rear 214 and container top 204 and container bottom 206 may sandwich container left side 208, container right side 210, container front 212, and container rear 214 to form a container interior 216 (FIG. 2).

Container top 204 may have material removed to define a first basket cutout 218 and a second basket cutout 220. First basket 300 may be removeably retained within first basket cutout 218 and second basket 302 may be removeably retained within second basket cutout 220. First basket cutout 218 and second basket cutout 220 generally may have rectangular shapes.

Each may provide open access to container interior 216 and each may have detents 222 (FIG. 2). Each detent 222 may be an elongated indentation formed into the surface of cutouts 218, 220. Each detent 222 may be configured to receive and retain a basket rib (such as first basket rib 320 (FIG. 2)) with a resistance that may be overcome by increased force. In one example, there may be one detent 222 for each of first basket cutout 218 and second basket cutout 220. In another example, there may be two detents 222 for each of first basket cutout 218 and second basket cutout 220. In another example, the two detents 222 for each of first basket cutout 218 may face each other.

Attached to container top 204 between first basket cutout 218 and a second basket cutout 220 may be a shaver head clevis 224. Shaver head clevis 224 may be a coupler shaped like the letter U with shaver head clevis holes 226 through each end. Shaver head clevis holes 226 (FIG. 2) may be openings in shaver head clevis 224 that may be aligned to receive shaver head clevis pin 228 (FIG. 2) through shaver head clevis holes 226 to complete a coupling. Shaver head clevis pin 228 may be an axis made of a short shaft that may support swivel 104 and permit swivel 104 to turn about shaver head clevis pin 228.

First basket 300 generally may have a rectangular, hollow shape. A first basket left side 304 and a first basket right side 306 may be attached between a first basket front 308 and a first basket rear 310. A first basket top 312 and a first basket bottom 314 may sandwich first basket left side 304, first basket right side 306, first basket front 308, and first basket rear 310 to form a first basket interior 316 (FIG. 2). Second basket 302 may have structure similar to first basket 300.

First basket top 312 may include basket vents 318. Basket vents 318 may be openings in first basket top 312 that may be large enough to permit air to flow from first basket interior 316 through basket vents 318 but small enough to assist in preventing loose fibers from flowing through basket vents 318. In one example, basket vents 318 may be a pattern of openings whose collective area is more than half an area of first basket top 312. In another example, there may be one hundred forty four basket vents 318 in a 12×12 pattern, where each vent 318 may have a square shape.

First basket bottom 314 may be solid. In one example, first basket bottom 314 may be removable from the remainder of first basket 300. This may permit a consumer to open up first basket 300 and remove fibers from first basket interior 316 for permanent disposal.

First basket left side 304 and first basket right side 306 may have similar structure. First basket right side 306 may include first basket rib 320 positioned near first basket top 312. First basket rib 320 may be an elongated bump extending from the surface of first basket right side 306 that may be configured to be received and retained by a detent 222 with a resistance that may be overcome by increased force. In one example, there may be one rib 320 for each detent 222.

First basket right side 306 also may include basket intake openings 322 positioned between first basket rib 320 and first basket bottom 314. Basket intake openings 322 may be empty spaces in first basket right side 306 that may permit air and fibers to pass from container interior 216 into first basket interior 316. Basket intake openings 322 may be oblong apertures having a collective area that approximately may be one-half an area of first basket right side 306. In one example, there may be five basket intake openings 322 that may be perpendicular to first basket rib 320. When first basket 300 and second basket 302 are installed in container 202, basket intake openings 322 maybe exposed to container interior 216 and may be free from obstruction.

First basket 300 may include a filter 324. Filter 324 may be positioned within first basket interior 316 against basket vents 318. Filter 324 may be a device that may remove fibers from air passing through filter 324. In one example, filter 324 may be a foam filter having a thickness of approximately 0.1 inch and having an area that may be large enough to cover basket vents 318.

Figure 3:
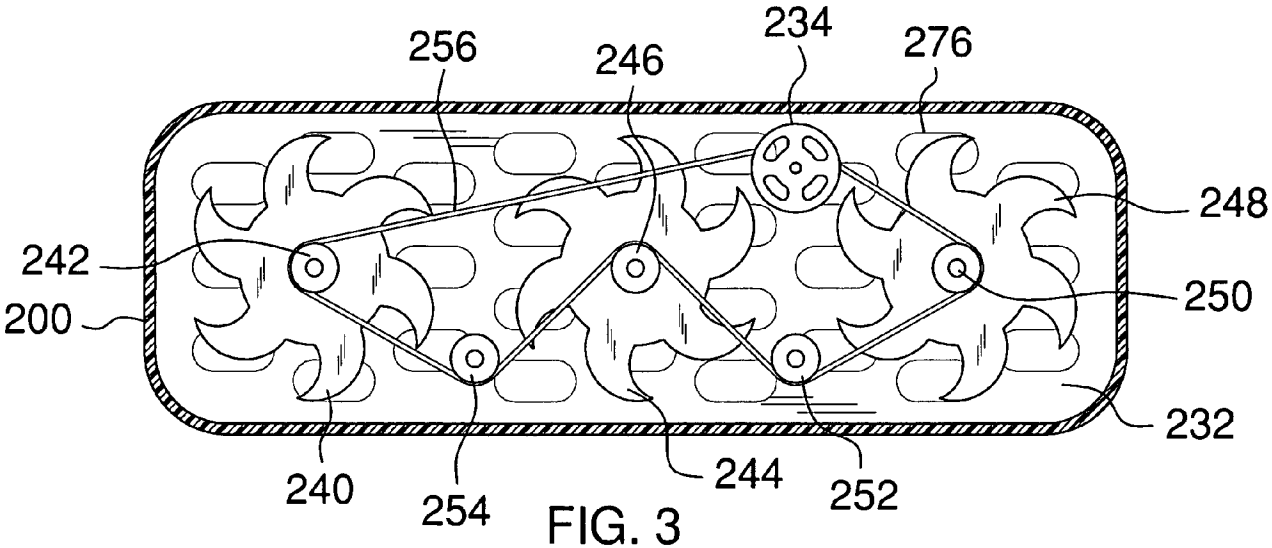
FIG. 3 is a top section view of shaver head 200 generally taken off line 3-3 of FIG. 2.
Figure 4:
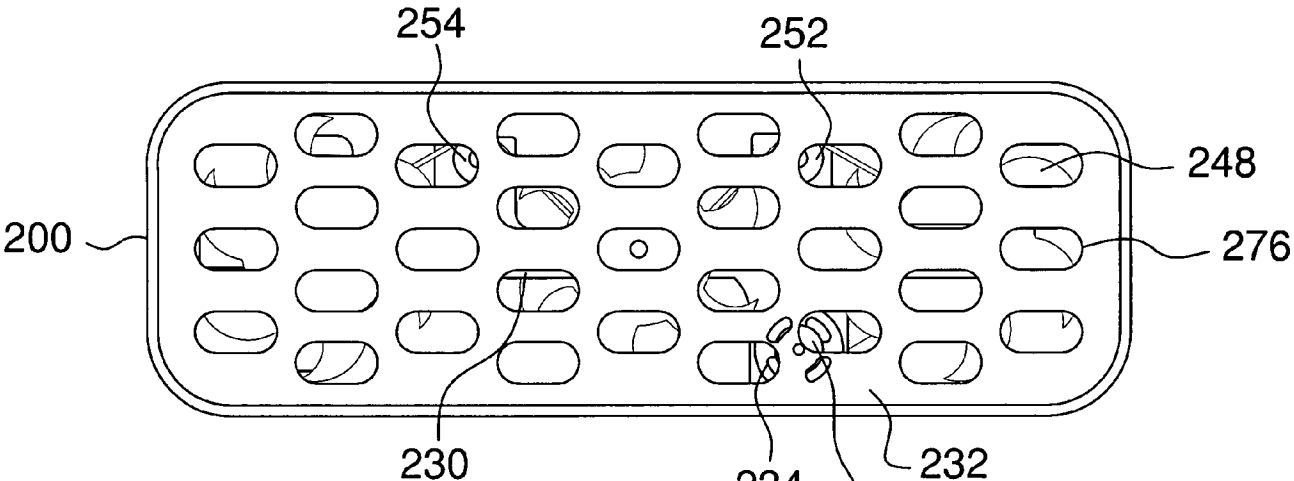
FIG. 4 is a bottom view of shaver head 200.
Figure 5:
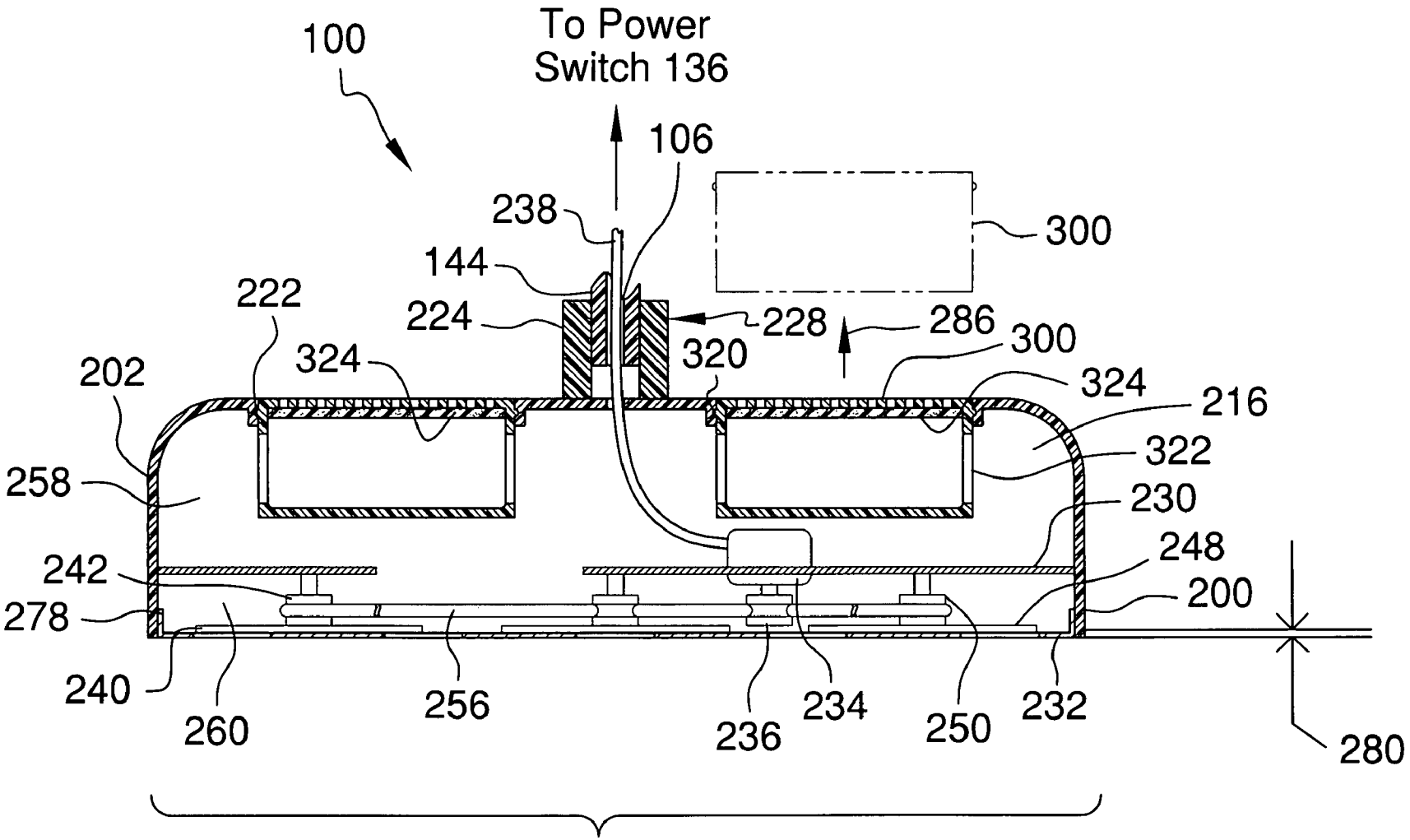
FIG. 5 is a front side section view of shaver head 200 generally taken off line 5-5 of FIG. 3.

FIG. 3 is a top section view of shaver head 200 generally taken off line 3-3 of FIG. 2. FIG. 4 is a bottom view of shaver head 200. FIG. 5 is a front side section view of shaver head 200 generally taken off line 5-5 of FIG. 3.

Shaver head 200 may include a mounting plate 230, a grill plate 232, a motor 234, a drive pulley 236, a wire 238, a left blade 240, a left blade pulley 242, a mid-blade 244, a mid-blade pulley 246, a right blade 248, a right blade pulley 250, a first direction pulley 252, a second direction pulley 254, and a drive belt 256.

Mounting plate 230 may be positioned and anchored within container interior 216 at position remote from container bottom 206 to form a fiber storage area 258 with container top 204. Fiber storage area 258 may be a confined void configured to receive and retain cut fibers through mounting plate 230. Basket interior 316 may be part of fiber storage area 258.

Grill plate 232 may be attached within container interior 216 at container bottom 206 to form a fiber cutting area 260 with mounting plate 230. Fiber cutting area 260 may be a confined void configured to receive fibers to be cut by left blade 240, mid-blade 244, and right blade 248.

Motor 234, left blade pulley 242, mid-blade pulley 246, right blade pulley 250, first direction pulley 252, second direction pulley 254 each may be attached to mounting plate 230 and substantially may be positioned within fiber cutting area 260. Drive pulley 236 may be attached to motor 234, left blade pulley 242 may be attached to left blade 240, mid-blade pulley 246 may be attached to mid-blade 244, and right blade pulley 250 may be attached to right blade 248. Drive belt 256 may be positioned within fiber cutting area 260 and may be wrapped against drive belt 256, left blade pulley 242, first direction pulley 252, mid-blade pulley 246, second direction pulley 254, left blade pulley 242. Wire 238 may pass through swivel hole 106 (FIG. 5) and be connected between motor 234 and power switch 136 (FIG. 1).

Figure 6:
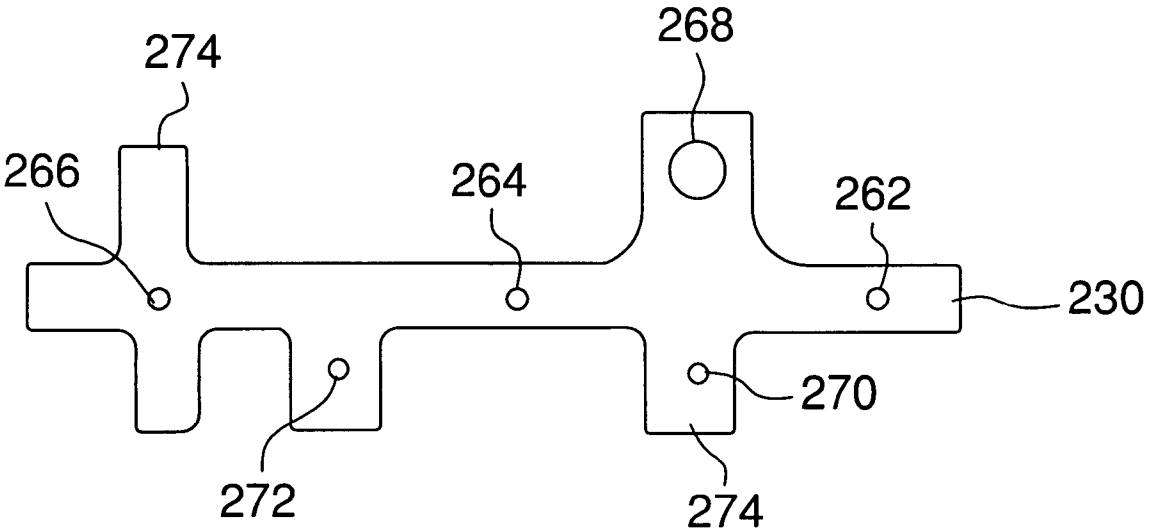
FIG. 6 is a top view of mounting plate 230.

FIG. 6 is a top view of mounting plate 230. Mounting plate 230 may be a structural member to which other parts may be attached. In one example, mounting plate 230 substantially may be a flat piece of material patterned to retain parts and allow fibers to pass from one side of mounting plate 230 to another side.

Mounting plate 230 may include a left blade pulley mount 262, a mid-blade pulley mount 264, a right blade pulley mount 266, a motor mount 268, a first direction pulley mount 270, a second direction pulley mount 272, and fastener tabs 274. Each mount 262-272 may include a feature such as a hole to which a pulley or motor may mount. Motor 234 may be attached to motor mount 268, left blade 240, mid-blade 244, and right blade 248 may be attached to left blade pulley mount 262, mid-blade pulley mount 264, and right blade pulley mount 266, respectively, and first direction pulley 252 and second direction pulley 254 may be attached to first direction pulley mount 270 and second direction pulley mount 272, respectively. Fastener tabs 274 may be extensions of mounting plate 230 configured to contact and become removeably fixed to container 202. Fastener tabs 274 may assist in fixing mounting plate 230 to the sides 208, 210, 212, 214 of container 202 at various locations. In one example, there may be seven fastener tabs 274.

Grill plate 232 may be a sheet of material having grill plate slots 276 and a grill plate lip 278 (FIG. 5) around a perimeter of grill plate 232. Grill plate 232 may be sized to fit snugly within container interior 216 against sides 208, 210, 212, 214. Grill plate 232 may be installed into and removed from container interior 216 with a slight pressure and its position may be overcome by increased pulling or pushing force Grill plate slots 276 may be openings grill plate 232 that may be large enough to permit one or several carpet strands and other fibers to pass into fiber cutting area 260 (FIG. 6) through grill plate slots 276. In one example, grill plate slots 276 may be a pattern of openings whose collective area approximately is equal to one half an area of grill plate 232. In another example, there may be thirty one grill plate slots 276 in alternating three slot/four slot columns, where each slot may have an oblong shape.

Motor 234 may be a device that may convert electrical power into mechanical rotary force and motion. Motor 234 may receive electricity through wire 238 to cause drive pulley 236 to rotate. Drive pulley 236 may include a wheel with a groove mounted on a drive shaft that may transmit power from motor 234 to drive belt 256 with which it may be in contact. Drive pulley 236 may be positive crowned and lagged.

Wire 238 may be a metal conductor that may carry electricity over a distance. With power switch 136 (FIG. 1) in an on position, electricity may flow from power cord 130 into wire 238. Wire 238 may then carry the electricity into motor 234.

Left blade 240, mid-blade 244, and right blade 248 each may be sharp tools configured to cut fibers. Left blade 240 may have curved blades extending from a base such that the pattern may resemble that of a sun. Left blade 240, mid-blade 244, and right blade 248 may have similar construction. Left blade 240, mid-blade 244, and right blade 248 each may be positioned parallel to and above grill plate 232 at a blade clearance distance 280 (FIG. 5). In one example, blade clearance distance 280 may be 0.1 inches.

Left blade pulley 242, mid-blade pulley 246, and right blade pulley 250 each may include a wheel with a groove mounted on a drive shaft that may transmit power into an associate blade from drive belt 256 with which it may be in contact. First direction pulley 252 and second direction pulley 254 each may include a wheel with a groove mounted on a drive shaft that may direct drive belt 256 towards a downstream blade pulley. Drive belt 256 may be a looped strip of flexible material configured to mechanically link and move rotating pulleys.

Figure 7:
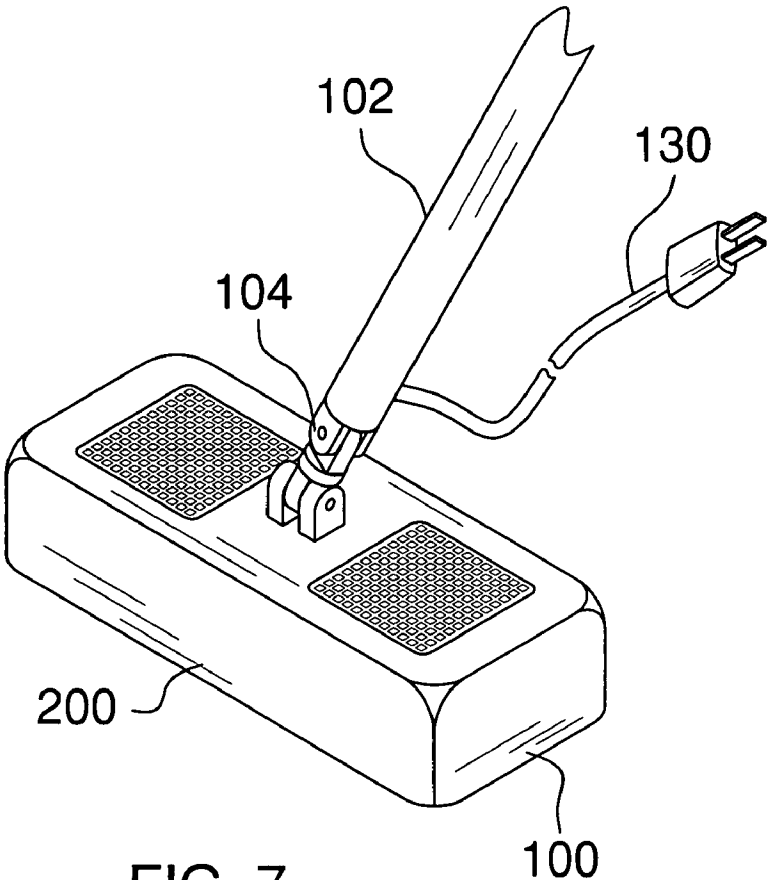
FIG. 7 is an isometric partial view of rug shaver 100.

FIG. 7 is an isometric partial view of rug shaver 100. In this embodiment, rug shaver includes power cord 130 attached through handle 120. Power cord 130 may travel with rug shaver 100 and may be wound around cord storage hook 140 (FIG. 1).

Figure 8:
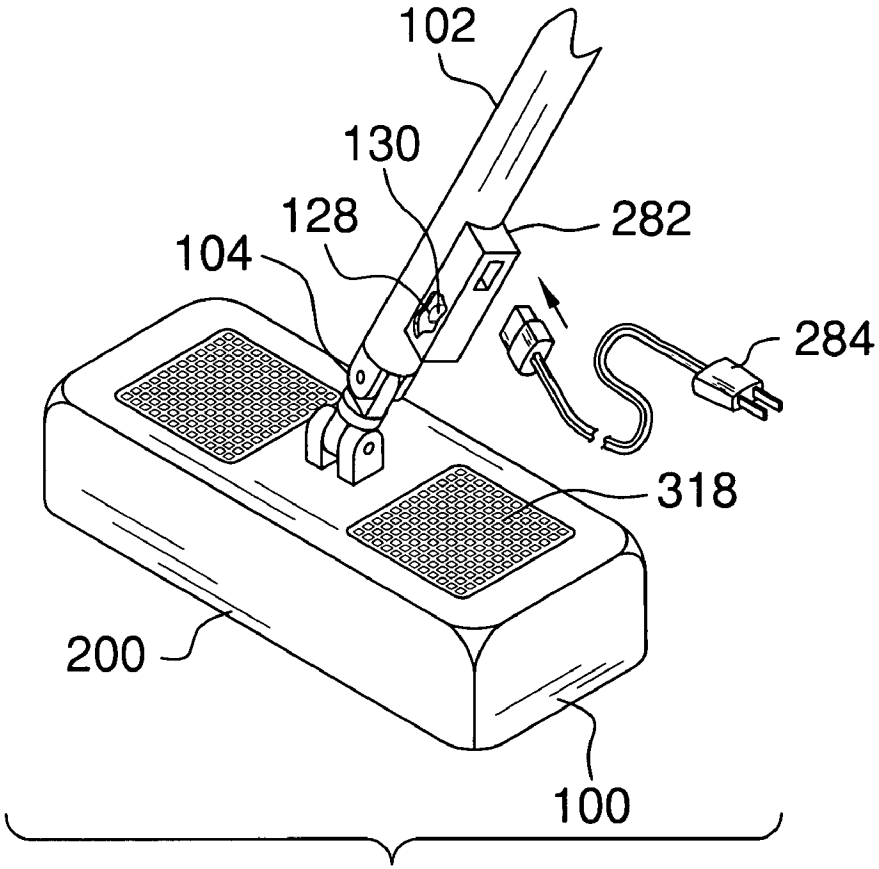
FIG. 8 is an isometric partial view of rug shaver 100.

FIG. 8 is an isometric partial view of rug shaver 100. In this example, rug shaver 100 may include a battery pack and charger 282 and a charge cord 284. Battery pack and charger 282 may be connected to power cord 130. Battery pack and charger 282 may include a multiple-use battery that may be restored to its full charge and re-used repeatedly. Battery pack and charger 282 also may include a device to charge or recharging batteries. Charge cord 284 may be part of a cable that may assist to temporarily connect battery pack and charger 282 to an electrical power source.

Figure 9:
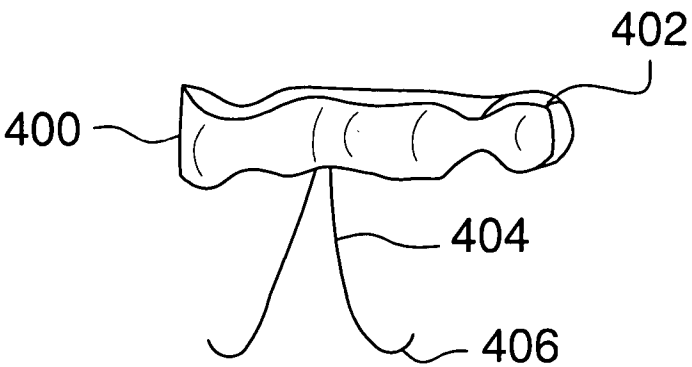
FIG. 9 is an isometric view of a lifting tool 400.

FIG. 9 is an isometric view of a lifting tool 400. Lifting tool 400 may be an implement that may assist in removing first basket 300 and second basket 302 from container 202. Lifting tool 400 may include a hook handle 402 connected to prongs 404, each of which may have a prong hook 406. In operation, a person may grab lifting tool 400 by hook handle 402 and insert prong hooks 406 through basket vents 318 so that prong hooks 406 catch basket top 312. Once prong hooks 406 catch basket top 312, the user may pull up on lifting tool 400 to bring along first basket 300 or second basket 302, such as in the direction of arrow 286 (FIG. 5).

In operation, shaver head 200 may be pressed against a fabric item, such as a rug, blanket, and a bedspread. Power switch 136 may be moved to an on position. This may cause left blade 240, mid-blade 244, and right blade 248 to rotate.

Fibers that extend past grill plate slots 276, into fiber cutting area 260, and above the rotating blades may be cut by the rotating blades. The rotating blades also may draw air through grill plate slots 276 to create an upward air flow. The upward air flow may carry cut fibers past mounting plate 230 into fiber storage area 258. Basket intake openings 322, foam filter 324, and basket vents 318 may permit the air flow to continue upward and out of shaver head 200. Basket intake openings 322 may permit the cut fibers to enter first basket 300 and second basket 302, while foam filters 324 may prevent the cut fibers from leaving first basket 300 and second basket 302 through basket vents 318. Thus, fibers cut by shaver head 200 may be received and temporarily stored in first basket 300 and second basket 302 for later disposal. With power switch 136 moved to an off position, first basket 300 and second basket 302 may be removed from container 202 using lifting tool 400 and the cut fibers emptied from first basket 300 and second basket 302. First basket 300 and second basket 302 then may be replaced back into first basket cutout 218 and second basket cutout 220, respectively.

The rug shaver may be an electrically or battery powered small appliance that may be utilized to remove pilling or fuzz from rugs. The rug shaver may be utilized to remove fuzz from blankets, bedspreads, and various other household items with a great deal of pilling. The rug shaver may include a small, square, or oval device, measuring 3 inches high, 12 inches long, and 4 inches wide, that may be powered by an electrical cord or a rechargeable battery pack. This small appliance may feature three rotating blade heads for ease in removing fuzz from rugs and other items. The rug shaver also may include a retractable, telescopic handle for added handling. The base of the rug shaver may include two vents, each with a removable cover. In addition, each vent may house a removable, foam filter for ease in cleaning.

For use, a person may extend the handle to a desired length, activate the rug shaver, and begin shaving fuzz and pilling from the surface of rugs, blankets, and bed spreads. After use, the filters may be removed for cleaning. This fuzz removing tool may be produced from plastic and in various decorative colors. The rug shaver also may include replaceable blades and filters.

The rug shaver may fulfill a need for a small appliance specially configured to provide a person with a tool that may be utilized to remove fuzz from a large fabric area while standing upright. Appealing features may include convenience, ease of use, timesaving, light weight, compact design, and effectiveness.

The rug shaver may include a telescopic handle for ease in adjusting the device to a comfortable, reachable length. With this electrically or battery-operated tool, a person may remove fuzz from rugs, blankets, and bedspreads. The rug shaver may save a person a considerable amount of time and effort while removing fuzz from his/her household. The fuzz shaver may convert a difficult chore into a simple task. This tool also may be utilized to quickly and easily remove fuzz from rugs, blankets, and bedspreads. With the rug shaver, a homemaker may keep rugs, blankets, and bedspreads looking new and presentable at all times. This may increase the pride a homemaker may take in the neatness and appearance of his or her home. The rug shaver also may be lightweight and compact to be easily stored when not in use. The rug shaver may provide the user with greater control and maneuverability when shaving fuzz from carpeting and other large surface area items. The rug shaver may be easy and comfortable to use, convenient, practical, and effective.

The rug shaver may be a telescope or retractable handle, swivel head, electric or rechargeable rug shaver. The rug shaver may be used on any surface that may have pilling. Three cutting heads inside a base may spin around to cut off unsightly pilling or fuzz. These cutting heads may be replaced as needed. On the top of the base may be two large holes with vent grills. Under the vent grills may be a washable foam filter. The lint may be sucked up into the two inch deep unit—on top—both sides, snap up, easy to clean out lint traps. The unit may be 12 inches long, three inches deep, and four inches wide. The unit may include plastic with a bottom grill having holes. The grill holes may be 1×½ inch oval.

The rug shaver may remove unsightly fuzz and pilling off a variety of items. The rug shaver may be plugged in or removed from a charger, turned on and used. From an upright position holding the elongated handle, a user quickly may move the rug shaver head back and forth, round and round, over large areas. Replacement cutting blades maybe sold in packages. The rug shaver may be light weight, large enough to do a quick job, easy to get under tables, pill chairs, bedspreads, blankets, and rugs.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A rug shaver to remove loose fibers from an object, the rug shaver comprising:

a handle having a handle length of at least two feet, where the handle includes shaft sections configured to lock in position relative to each other and to slide one within another to vary the handle length;

a swivel;

a shaver head connected to the handle through the swivel, where the shaver head includes a container having a container left side and a container right side attached between a container front and a container rear, where the container left side, the container right side, the container front, and the container rear are positioned between a container top and a container bottom to form a container interior, where the container top has material removed to form a basket cutout;

a basket removeably retained within the basket cutout, where the basket includes a basket left side and a basket right side attached between a basket front and a basket rear, where the basket left side, the basket right side, the basket front, and the basket rear are positioned between a basket top and a basket bottom to form a basket interior, where the basket top includes basket vents that are large enough to permit air to flow from the basket interior through basket vents but small enough to assist in preventing loose fibers from flowing through the basket vents, where the basket right side includes basket intake openings that are exposed to the container interior;

a filter positioned within the basket interior against the basket vents;

a grill plate removeably attached within the container interior at the container bottom, where the grill plate has grill plate slots, where each grill plate slot is large enough to permit one or several fiber strands to pass through that grill plate slot;

a mounting plate anchored within the container interior between the grill plate and the container top;

a motor attached to the mounting plate; and blades connected to the motor through a drive belt and attached to the mounting plate above the grill plate.

2. The rug shaver of claim 1, further comprising:

a power cord connected to the motor, where a second shaft section is positioned between a first shaft section and a third shaft section, where the first shaft section is attached to the swivel, and where the power cord extends through the first shaft section;

a power switch having a power switch lever extending though the third shaft section, where the power cord is connected to the power switch and a wire connects the power switch to the motor; and a cord storage hook attached to the third shaft section on a side of the third shaft section that is opposite of the power switch lever.

3. The rug shaver of claim 1, further comprising:

a battery pack and charger, where a second shaft section is positioned between a first shaft section and a third shaft section, where the first shaft section is attached to the swivel, and where the power cord extends through the first shaft section, and where the battery pack and charger is attached to the first shaft section.

4. The rug shaver of claim 1, further comprising:

a power switch having a power switch lever extending though the third shaft section, where the power cord is connected to the power switch and a wire connects the power switch to the motor, where the swivel includes a swivel hole and where the wire passes through the swivel hole.

5. The rug shaver of claim 1, where the basket cutout includes a detent and the basket includes a basket rib positioned to fit within the detent.

6. The rug shaver of claim 5, where the basket right side includes a basket rib positioned near the basket top.

7. The rug shaver of claim 6, where the basket cutout includes exactly two detents.

8. The rug shaver of claim 5, where the basket bottom is solid and removeably attached to the basket left side, the basket right side, the basket front, and the basket rear.

9. The rug shaver of claim 5, where the basket has a rectangular shape.

10. The rug shaver of claim 5, where the grill plate slots are a pattern of openings whose collective area approximately is equal to one half an area of the grill plate.

11. A rug shaver to remove loose fibers from an object, the rug shaver comprising:

a handle having a handle length of at least two feet, where the handle includes shaft sections configured to lock in position relative to each other and to slide one within another to vary the handle length;

a swivel; and a shaver head connected to the handle through the swivel, where the shaver head includes a container having a container left side and a container right side attached between a container front and a container rear, where the container left side, the container right side, the container front, and the container rear are positioned between a container top and a container bottom to form a container interior, where the container top has material removed to form a basket cutout;

a basket removeably retained within the basket cutout, where the basket includes a basket left side and a basket right side attached between a basket front and a basket rear, where the basket left side, the basket right side, the basket front, and the basket rear are positioned between a basket top and a basket bottom to form a basket interior, where the basket top includes basket vents that are large enough to permit air to flow from the basket interior through basket vents but small enough to assist in preventing loose fibers from flowing through the basket vents, where the basket right side includes basket intake openings that are exposed to the container interior;

a motor;

a grill plate removeably attached within the container interior at the container bottom, where the grill plate has grill plate slots, where each grill plate slot is large enough to permit one or several fiber strands to pass through that grill plate slot; and blades connected to the motor and positioned within the container interior to rotate above the grill plate, where the basket cutout includes a detent and the basket includes a basket rib positioned to fit within the detent.

12. The rug shaver of claim 11, further comprising:

a filter positioned within the basket interior against the basket vents;

a mounting plate anchored within the container interior between the grill plate and the container top, where the motor is attached to the mounting plate and the blades are connected to the motor through a drive belt and attached to the mounting plate above the grill plate.

13. The rug shaver of claim 12, further comprising:

a power cord connected to the motor, where a second shaft section is positioned between a first shaft section and a third shaft section, where the first shaft section is attached to the swivel, and where the power cord extends through the first shaft section;

a power switch having a power switch lever extending though the third shaft section, where the power cord is connected to the power switch and a wire connects the power switch to the motor; and a cord storage hook attached to the third shaft section on a side of the third shaft section that is opposite of the power switch lever.

14. The rug shaver of claim 12, further comprising:

a battery pack and charger, where a second shaft section is positioned between a first shaft section and a third shaft section, where the first shaft section is attached to the swivel, and where the power cord extends through the first shaft section, and where the battery pack and charger is attached to the first shaft section.

15. The rug shaver of claim 12, further comprising:

a power switch having a power switch lever extending though the third shaft section, where the power cord is connected to the power switch and a wire connects the power switch to the motor, where the swivel includes a swivel hole and where the wire passes through the swivel hole.

16. The rug shaver of claim 12, where the basket right side includes a basket rib positioned near the basket top.

17. The rug shaver of claim 12, where the basket bottom is solid and removeably attached to the basket left side, the basket right side, the basket front, and the basket rear.

18. The rug shaver of claim 11, where the grill plate slots are a pattern of openings whose collective area approximately is equal to one half an area of the grill plate.

* * * * *